US006851338B2

(12) United States Patent
Wu

(10) Patent No.: US 6,851,338 B2
(45) Date of Patent: Feb. 8, 2005

(54) APPARATUS OF ADJUSTABLE WRENCH FOR SECURING MOVABLE JAW

(76) Inventor: Arthur Wu, No. 22, Alley 28, Lane 360, Chung Shan Rd. She Kou Village Shen Kang Hsiang, Taichung Hsien (TW), 429

( * ) Notice: Subject to any disclaimer, the term of this patent is extended or adjusted under 35 U.S.C. 154(b) by 0 days.

(21) Appl. No.: 10/373,855

(22) Filed: Feb. 27, 2003

(65) Prior Publication Data

US 2004/0168553 A1 Sep. 2, 2004

(51) Int. Cl.[7] ..... B25B 13/16
(52) U.S. Cl. ..... 81/170; 81/157
(58) Field of Search ..... 81/155, 157, 170, 81/173, 175, 176

(56) References Cited

U.S. PATENT DOCUMENTS

| | | | | | |
|---|---|---|---|---|---|
| 1,160,494 | A | * | 11/1915 | Bush | 81/165 |
| 1,228,850 | A | * | 6/1917 | Upson | 81/157 |
| 1,402,686 | A | * | 1/1922 | Trabold | 81/157 |
| 1,747,360 | A | * | 2/1930 | Giles | 81/157 |
| 2,499,644 | A | * | 3/1950 | Heyn | 81/157 |
| 2,569,581 | A | * | 10/1951 | Ryland | 81/165 |
| 2,709,387 | A | * | 5/1955 | Brynge | 81/165 |
| 4,214,491 | A | * | 7/1980 | Martinmaas | 81/134 |
| 4,344,339 | A | * | 8/1982 | Penner | 81/157 |
| 4,472,986 | A | * | 9/1984 | Gottlieb | 81/157 |
| 5,209,144 | A | * | 5/1993 | Lu Guoji | 81/165 |
| 5,540,125 | A | * | 7/1996 | Haskell | 81/170 |
| 5,941,142 | A | * | 8/1999 | Janson | 81/165 |
| 6,128,980 | A | * | 10/2000 | Hu | 81/170 |

* cited by examiner

*Primary Examiner*—David B. Thomas
(74) *Attorney, Agent, or Firm*—Bacon & Thomas PLLC

(57) ABSTRACT

An adjustable wrench includes a handle having a head portion provided with a fixed jaw, a transverse guiding slot and an opening communicated with the guiding slot. A movable jaw has a guiding portion received movably in the guiding slot of the handle and a rack on the guiding portion. An adjusting worm has a through hole and a helical tooth, wherein the adjusting worm is received in the opening and engages the helical tooth with the rack of the movable jaw. A supporting device is made of a flexible material and has at least a part received in the through hole of the adjusting worm to make the adjusting worm can be turned along the supporting device and can be moved along a diameter orientation thereof, and a driving device is provided on the handle for moving the adjusting worm toward the movable jaw.

14 Claims, 10 Drawing Sheets

APPARATUS OF ADJUSTABLE WRENCH FOR SECURING MOVABLE JAW

BACKGROUND OF THE INVENTION

1. Field of the Invention

The present invention relates generally to a hand tool, and more particularly to an adjustable wrench, which has can secure the movable jaw when it moved to a predetermined position.

2. Description of the Related Art

A conventional adjustable wrench comprised a handle having a fixed jaw at an end thereof, a movable jaw slidably provided on the handle having a rack and an adjusting worm pivoted on the handle and engaged with the rack of the movable jaw such that the movable jaw can be moved by turning the adjusting worm.

There must be a clearance of teeth left between the rack of the movable jaw and a helical tooth of the adjusting worm to make the adjusting worm can drive the movable jaw to move smoothly. But the movable jaw can not stand fixedly because of the clearance of teeth such that the distance between the movable jaw and the fixed jaw can not be kept in a same size, even through the adjusting worm had not been turned.

FIG. 12 shows a conventional apparatus for an adjustable wrench to secure a movable jaw 78. The adjustable wrench has a hole 74 on a handle 72 and a fastening device 76 provided in the hole 74. The fastening device 76 can be screwed into the hole 74 and press the movable jaw 78 to secure the movable jaw.

FIG. 13 shows a second conventional adjustable wrench having a screw bar 82 driven by a nut 80 to press a movable jaw 84.

FIG. 14 shows a third conventional adjustable wrench having a rectangular slide 86 sliding transversely and against a worm 88 to make the worm 88 can not be turned.

FIG. 15 shows a fourth conventional adjustable wrench having a movable plate 90 with teeth 90 thereon engaged with clutch teeth 96 at a movable jaw 94.

FIG. 16 shows a fifth conventional adjustable wrench having a locking disk 98 to secure a adjusting worm 100.

FIG. 17 shows a sixth conventional adjustable wrench having a control mechanism 102 to move a worm 104 and make the worm against a movable jaw 106.

SUMMARY OF THE INVENTION

The primary objective of the present invention is to provide an adjustable wrench, which has an apparatus to secure the movable jaw as user wants.

According to the objective of the present invention, an adjustable wrench comprises a handle having a head portion and shank, wherein the head portion has a fixed jaw, a transverse guiding slot and an opening communicated with the guiding slot. A movable jaw has a guiding portion and a rack on the guiding portion, wherein the movable jaw receives the guiding portion in the guiding slot of the handle to be moved toward or away from the fixed jaw. An adjusting worm has a through hole and a helical tooth, wherein the adjusting worm is received in the opening and engages the helical tooth with the rack of the movable jaw. A supporting device is made of a flexible material and has at least a part received in the through hole of the adjusting worm to make the adjusting worm can be turned along the supporting device and can be moved along a diameter orientation thereof, and a driving device is provided on the handle for moving the adjusting worm toward the movable jaw.

DETAILED DESCRIPTION OF THE INVENTION

Figure 1:
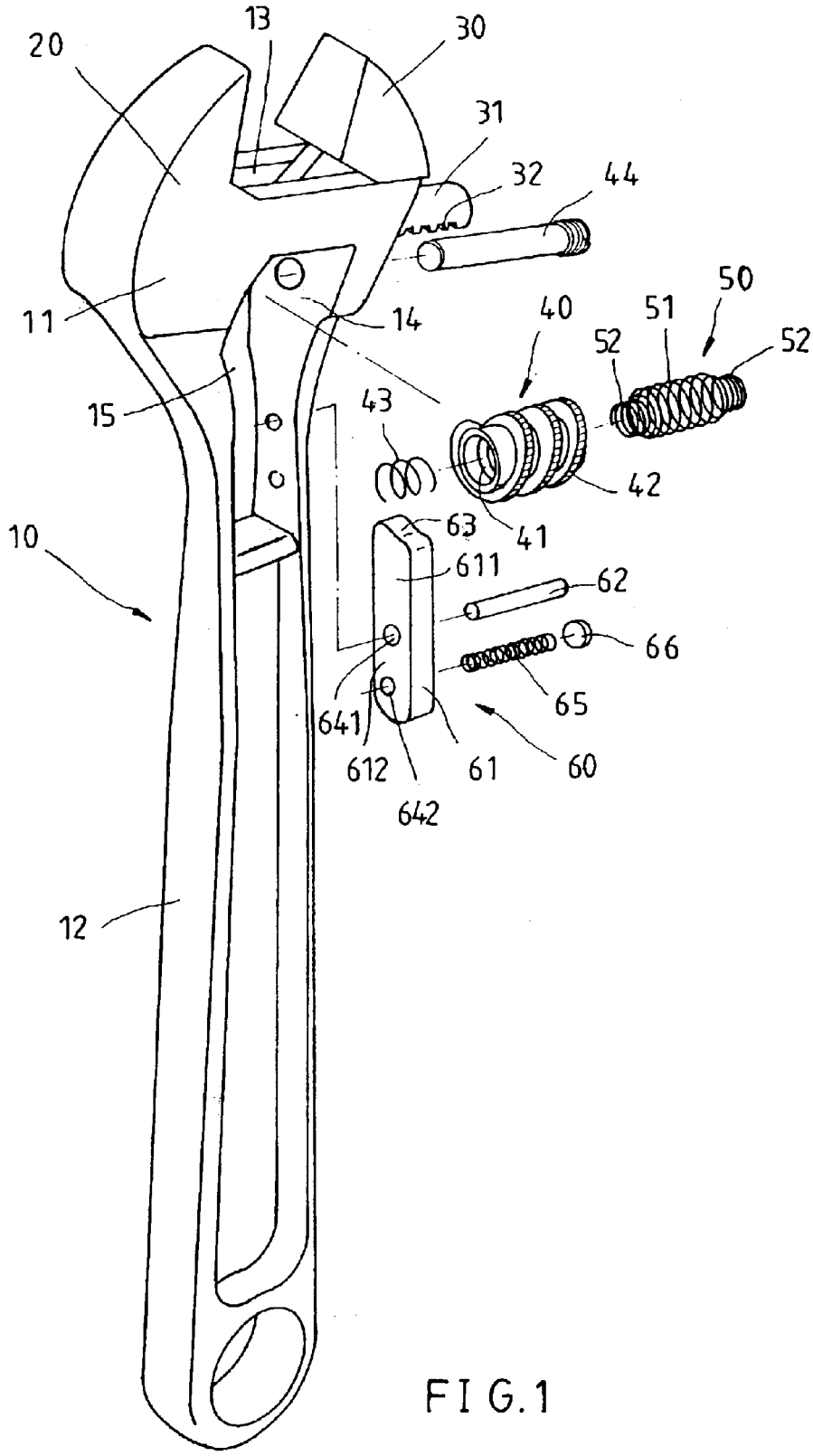
FIG. 1 is an exploded view of a preferred embodiment of the present invention.

Please refer to FIG. 1, an adjustable wrench of the preferred embodiment of the present invention mainly comprises a handle 10 having a fixed jaw 20 at an end thereof, a movable jaw 30, an adjusting jaw 40, a supporting device 50 and a driving device 60.

The handle 10 has a head portion 11 and a shank 12. The fixed jaw 20 is located at a distal end of the head portion 11. The head 11 is provided with a transverse guiding slot 13 and an opening 14 under the guiding slot 13 and communicated with it. The shank 12 has a gap 15 communicated with the opening 14.

The movable jaw 30 has a guiding portion 31 at an end thereof to be received in the guiding slot 13 of the handle 10 such that the movable jaw 30 can move along the guiding slot 13.

The adjusting worm 40 has a through hole 41 at center and a helical tooth 42 at an outer surface. The adjusting worm 40 is received in the opening 14 with a spring 43 against which an end on a sidewall of the opening 14 and against which the other end on the adjusting worm 40. A shaft 44 runs through the head 11, the spring 43 and the through hole 41 of the adjusting worm so as to pivot the adjusting worm 40 on the handle 10. The diameter of the through hole 41 of the adjusting worm 40 is larger than the diameter of the shaft 44.

Figure 2:
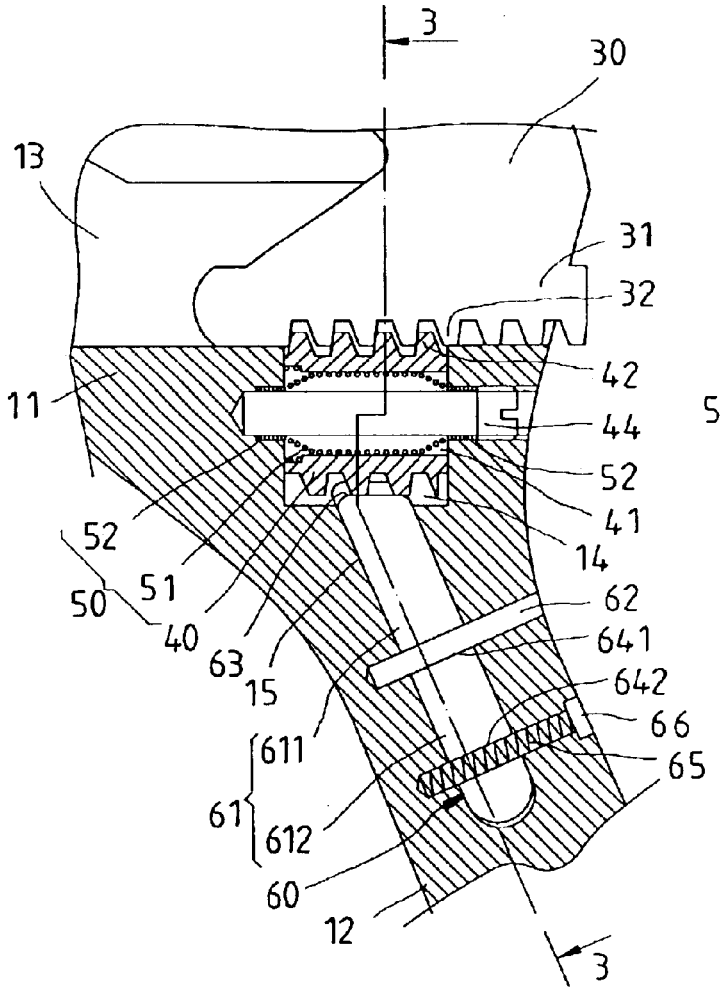
FIG. 2 is a sectional view in part of the preferred embodiment of the present invention, showing the adjusting worm located at initial position.

The supporting device 50 is a spiral spring the present embodiment, as shown in FIG. 2, having a larger diameter portion 51 and two smaller diameter portions 52 at opposite ends of the larger diameter portion 51 respectively. The supporting device 50 is inserted into the through hole 41 of the adjusting worm 40 and let the shaft 44 passing therethrough so as to make the larger diameter portion 51 against a sidewall of the through hole 41 and the smaller diameter portions 52 against the shaft 44. Therefore, the adjusting worm 40 is turned along the shaft 44 and is moved along diameter orientations thereof.

When the adjusting worm 40 is forced to move along the diameter orientation, the larger diameter portion 51 strains and the strain can provide a spring force to move the adjusting worm 40 back to the initial position when the external force has gone.

The driving device 60 is to move the adjusting worm 40 toward the movable jaw 30 in the present invention and in the present preferred embodiment, the driving device 60 has an elongated main member 61 received in the gap 15 of the shank 12. The main member 61 is pivoted on the shank 12 by means of a pin 62 inserted into the shank 12 and a first through hole 641 on the main member 61. The main member 61 now is defined as two sections 611 and 612, wherein the first section 611 is proximal to the adjusting worm 40 with a cam face 62 at an end thereof and the second section 612 is distal to the adjusting worm 40 having a spring 65 running through the shank 12 and a second through hole 642 on the second section 612. A plug 66 is to close on opening on the shank 12.

Figure 3:
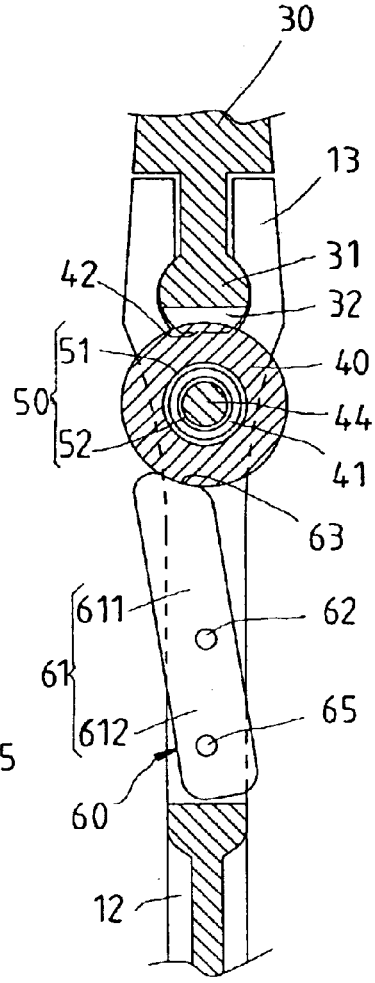
FIG. 3 is a sectional view along the 3—3 line in FIG. 2.
Figure 5:
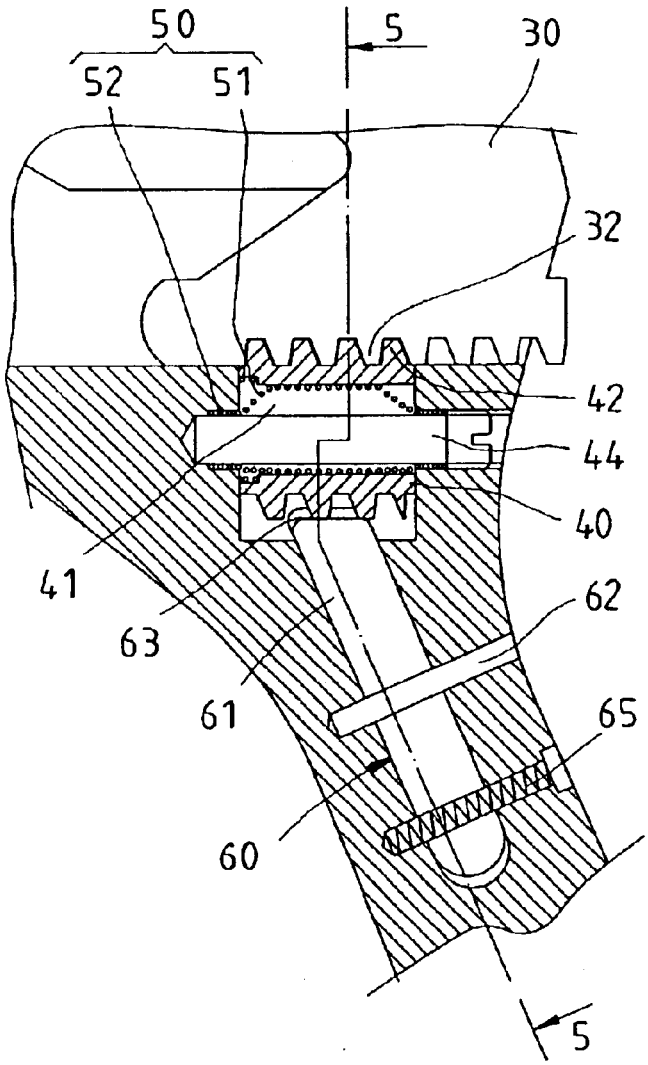
FIG. 5 is a sectional view along the 5—5 line in FIG. 4.
Figure 4:
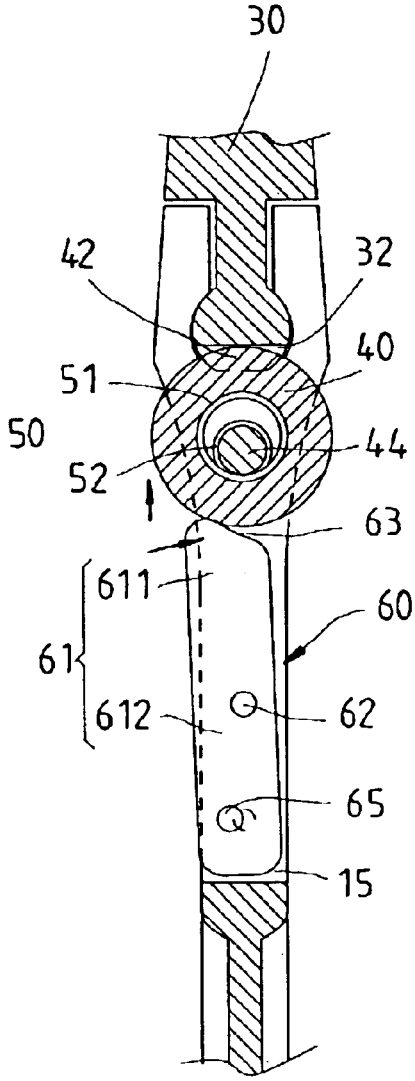
FIG. 4 is a sectional view in part of the preferred embodiment of the present invention, showing the adjusting worm moved toward the movable jaw to eliminate the clearance of teeth between the adjusting worm and the rack of the movable jaw.

FIG. 2 and FIG. 3 show the adjustable wrench of the present invention under an initial status, the cam face 62 of the supporting device 60 is not in contact with the adjusting worm 40 and the larger diameter portion 51 of the supporting device 50 has no strain. The cam face 62 of the supporting device 60 pushes the adjusting worm 40 when user press down the second section 612 of the main member 61 and the adjusting worm 40 is forced to move toward the movable jaw 30 in a predetermined distance as shown in FIG. 4 and FIG. 5. The moving distance of the adjusting worm depends on the size of the adjustable wrench. Typically, the distance is in a range between 0.5 mm and 1.5 mm.

When the adjusting worm 40 is pushed toward the movable jaw 30 by the driving device 60, the larger portion 51 of the supporting device 50 strains. At the same time, the clearance of teeth between the rack 32 of the movable jaw 30 and the helical tooth 42 of the adjusting worm 40 will be reduced or be eliminated, and therefore the movable jaw 30 is secured.

In use, the adjusting worm 30 is turned to move the movable jaw 30 to a desired position, and then the main member 61 of the driving device 60 is pressed for which the cam face 63 is in contact with the adjusting worm 40 and forces it toward the movable jaw 30 to eliminate the clearance of teeth between the rack 32 of the movable jaw 30 and the helical tooth 42 of the adjusting worm 40. The driving device 60 now prevents the adjusting worm 40 from being turned and the movable jaw 30 is secured too. At such condition, the adjustable wrench of the present invention serves as an open-end wrench.

To release the adjustable jaw 30, the main member 61 is pressed and the spring 65 will help it back to the initial position, and then the adjusting worm 40 will return to the initial position because of the main member 61 does not push it anymore. The clearance of teeth between the rack 32 of the movable jaw 30 and the helical tooth 42 of the adjusting worm 40 now will be back to normal so that the movable jaw 30 can be moved by the adjusting worm 40 freely again.

Figure 6:
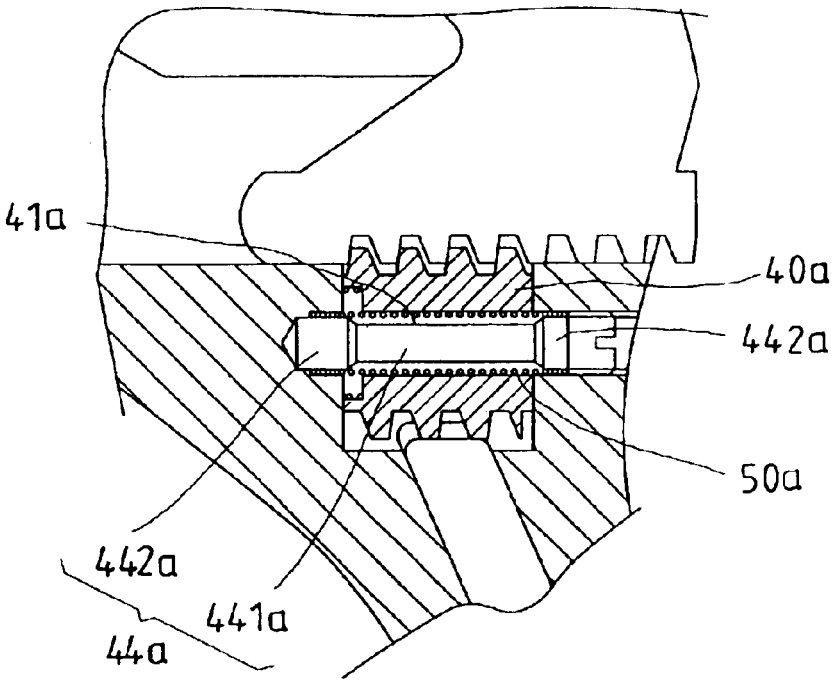
FIG. 6 is a sectional view, showing a second type of the supporting device.

FIG. 6 shows a second type of the combination of an adjusting worm 40*a* and a supporting device 50*a*, wherein a shaft 44*a* has a smaller diameter section 441*a* and two larger diameter sections 442*a* at opposite ends of the smaller diameter section 441*a* respectively. The length of the smaller diameter section 441*a* is longer than a through hole 41*a* of the adjusting worm 40. The supporting device 50*a* is a spring with a single diameter slightly larger than the larger diameter sections 442*a*. The shaft 44*a* is inserted into the spring 50*a* with which the larger diameter sections 442*a* against the spring 44*a* and the shaft 44*a* and the spring 44*a* are inserted into the through hole 41*a* of the adjusting worm 40*a* with the spring 50*a* against a sidewall of the through hole 41*a* of the adjusting worm 40*a*. The adjusting worm 40*a* can be turned along the shaft 44*a* and the spring 50*a* and can be forced to move along diameter orientations thereof for a distance.

Figure 7:
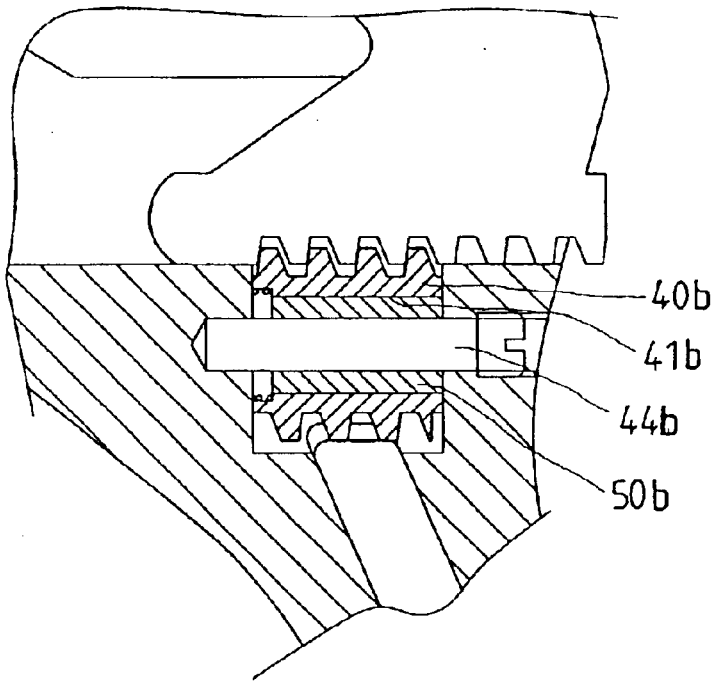
FIG. 7 is a sectional view, showing a third type of the supporting device.

FIG. 7 shows a third type of combination having an adjusting worm 40*b* has a through hole 41*b*, a shaft 44*b* passing through the through hole 41*b* and a supporting device 50*b*. The diameter of the through hole 41*a* of the adjusting worm 40*b* is larger than the diameter of the shaft 44*b*. The supporting device 50*b* is a hollow element and is made of a flexible material such as rubber, foaming material and the like. The flexible hollow element 50*b* is received in the through hole 41*b* of the adjusting worm 40*b* between the shaft 44*b* and a sidewall of the through hole 41*b*. With this combination, the adjusting worm 40*b* severs as same as above.

The flexible hollow element above might provide larger friction while the adjusting worm is turned. It may be fixed by adding lubrication or providing an oil-impregnated hollow element.

Figure 8:
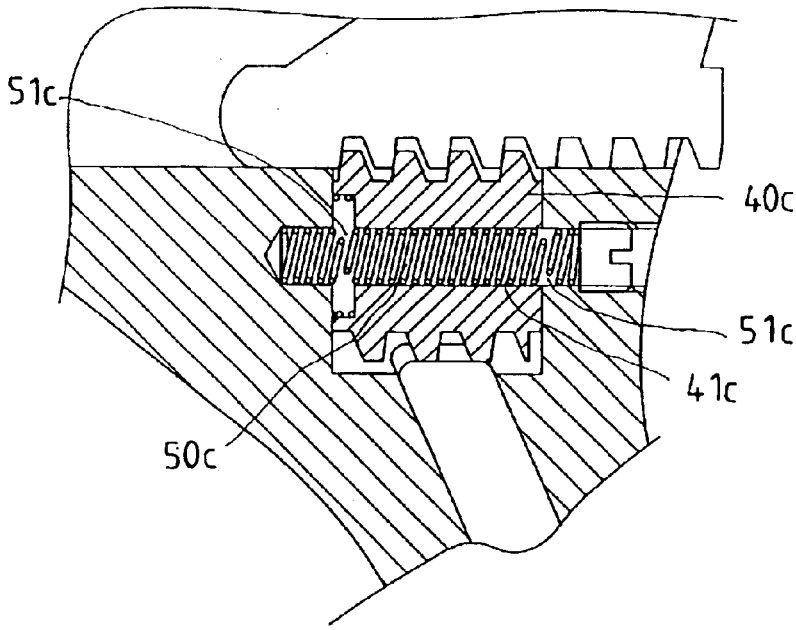
FIG. 8 is a sectional view, showing a fourth type of the supporting device.

FIG. 8 shows a fourth combination having an adjusting worm 40*c* and a supporting device 50*c*, wherein the supporting device 50*c* is a spiral spring inserted into a through hole 41*c* of the adjusting worm 40*c*. The spring 50*c* has two smaller diameter portions 51*c* at where corresponds to opposite ends of the adjusting worm 40*c*. The smaller diameter portions 51*c* can provide more flexibility while the adjusting worm 40*c* is moved and prevent the spring 50*c* from damage because of the shear force.

Figure 9:
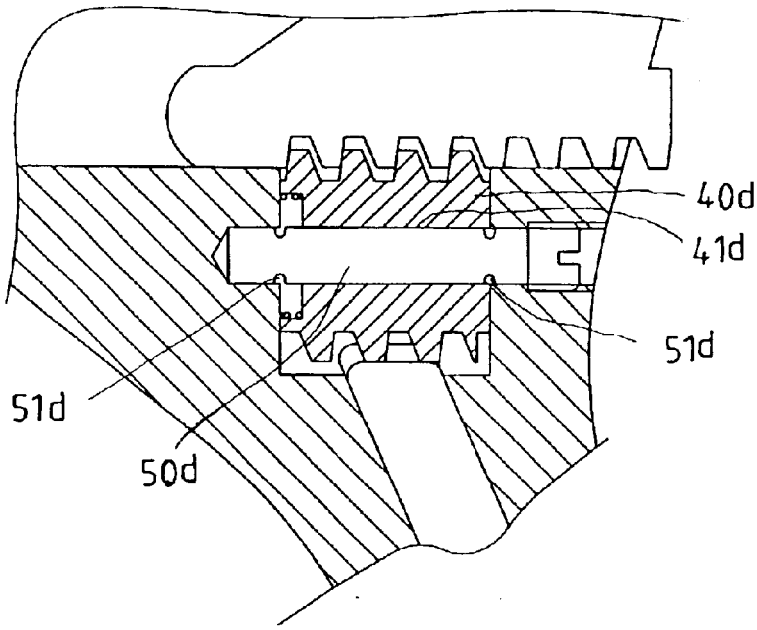
FIG. 9 is a sectional view, showing a fifth type of the supporting device.

FIG. 9 shows a fifth combination with a supporting device 50*d* made of flexible material into a shaft so as to be replaced with the spring 50*c* above. The flexible shaft 50*d* also has two annular recesses 51*d* served as the smaller diameter portions 51*c* of the spring 50*c*.

Figure 10:
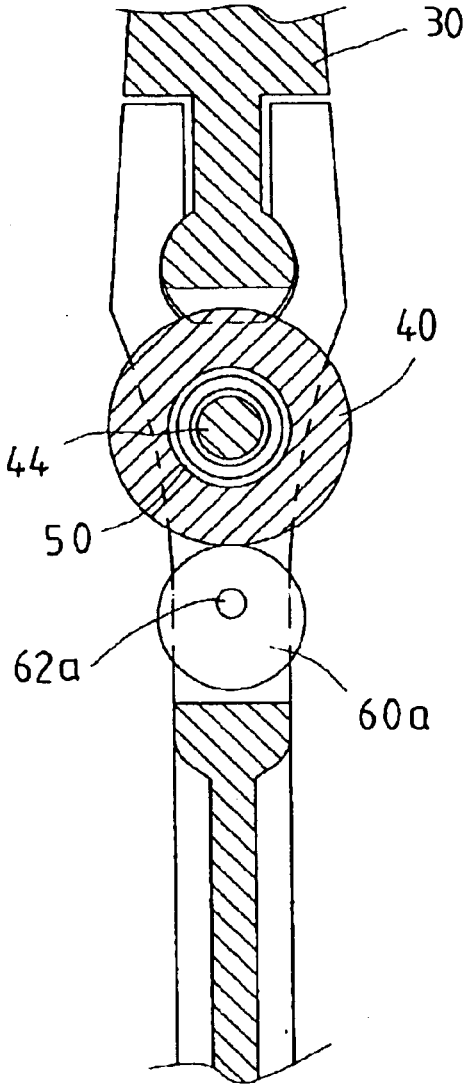
FIG. 10 is a sectional view, showing a second type of the driving device.
Figure 12:
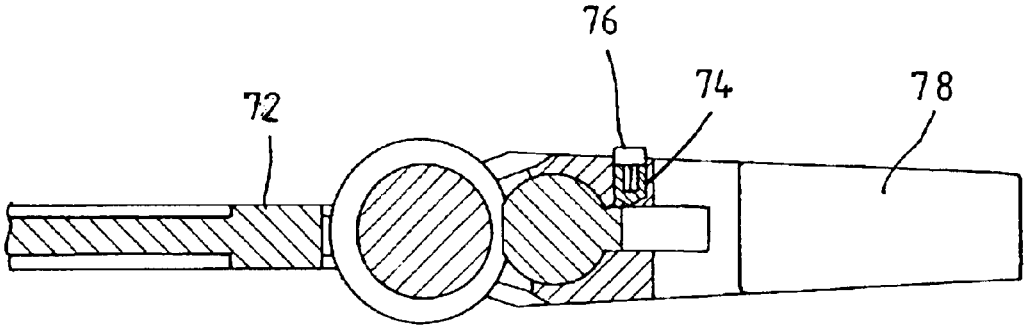
FIG.12 PRIOR ART
FIG. 12 is a perspective view of a first conventional adjustable wrench with apparatus to secure the movable jaw.
Figure 13:
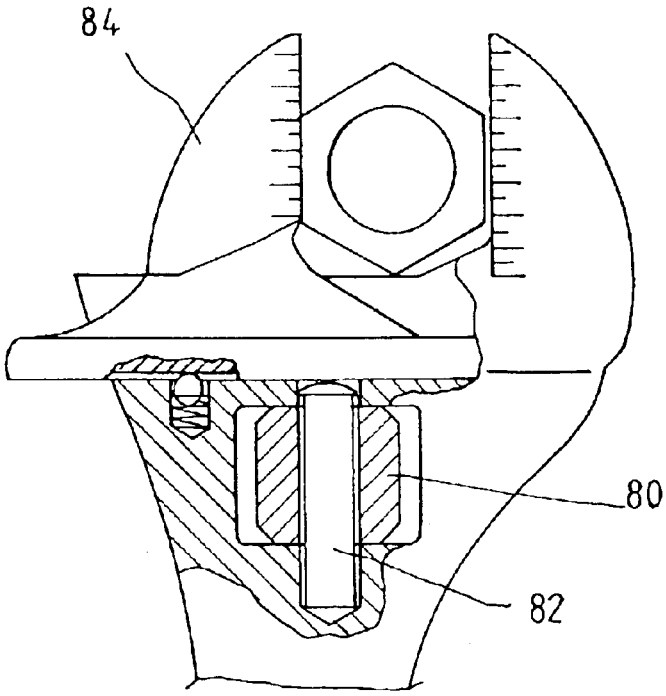
FIG.13 PRIOR ART
FIG. 13 is a perspective view of a first conventional adjustable wrench with apparatus to secure the movable jaw.
Figure 14:
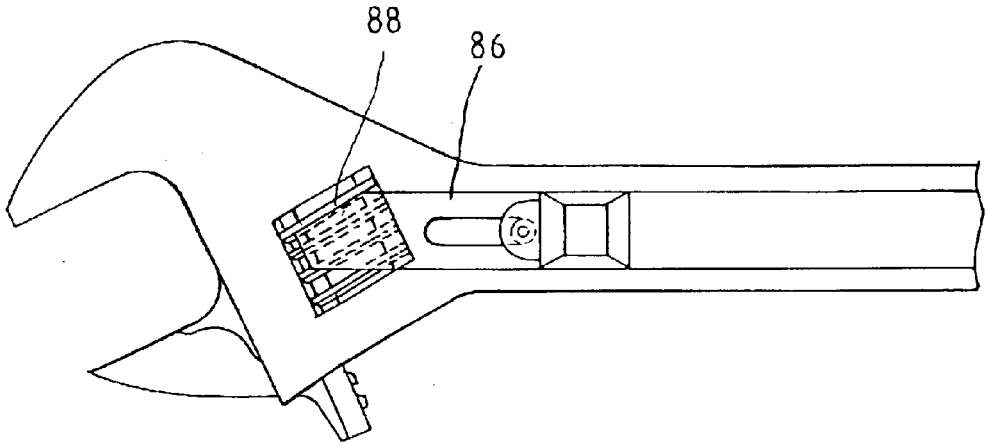
FIG.14 PRIOR ART
FIG. 14 is a perspective view of a first conventional adjustable wrench with apparatus to secure the movable jaw.
Figure 15:
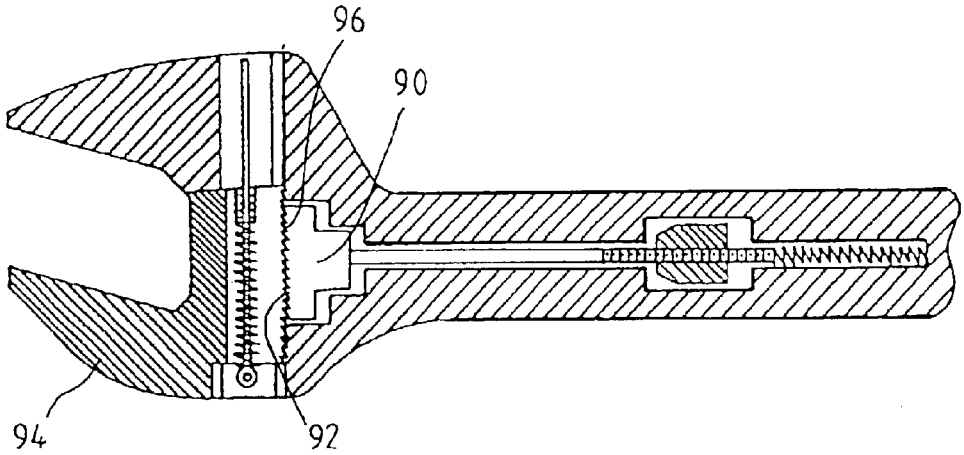
FIG.15 PRIOR ART
FIG. 15 is a perspective view of a second conventional adjustable wrench with apparatus to secure the movable jaw.
Figure 16:
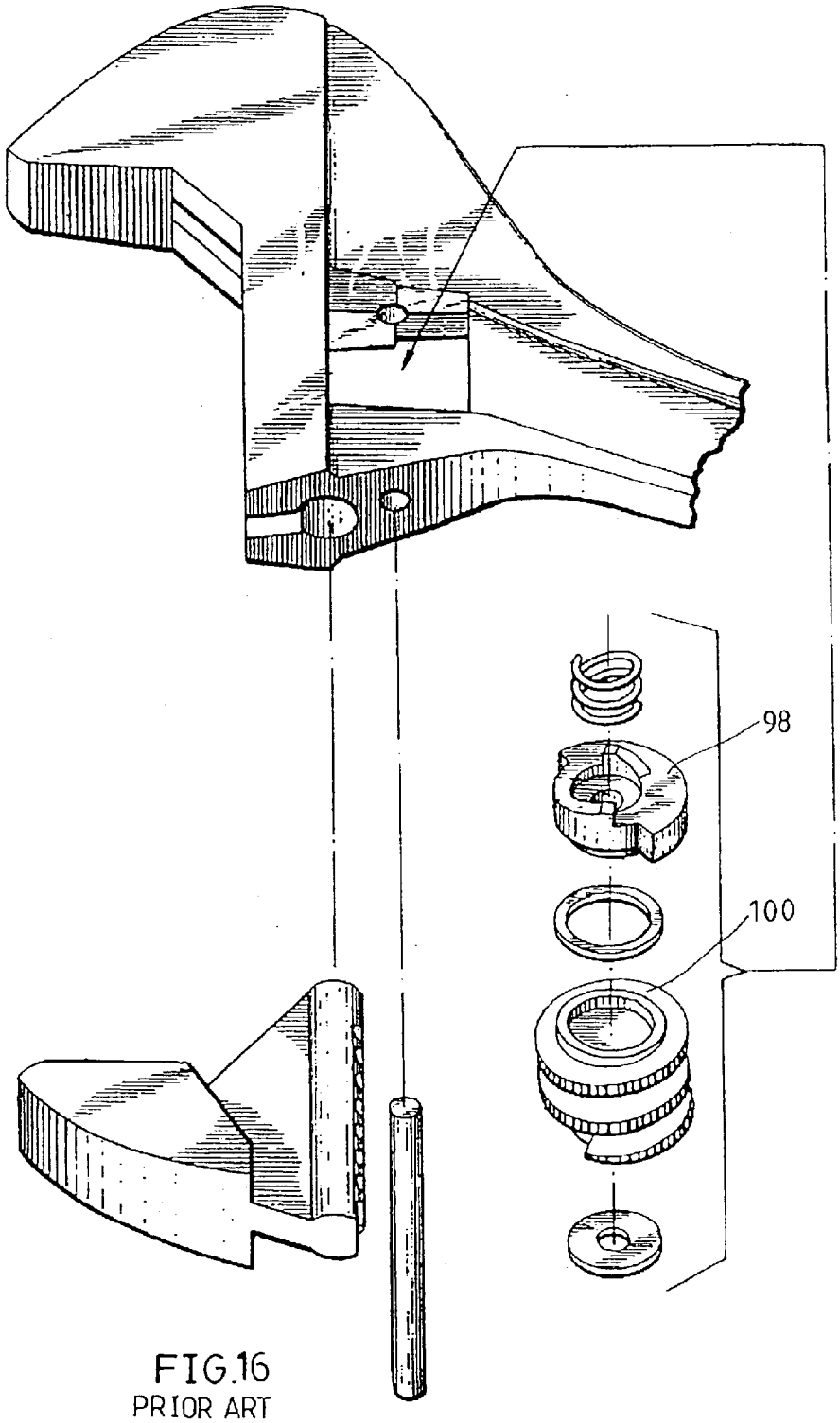
FIG.16 PRIOR ART
FIG. 16 is a perspective view of a third conventional adjustable wrench with apparatus to secure the movable jaw.
Figure 17:
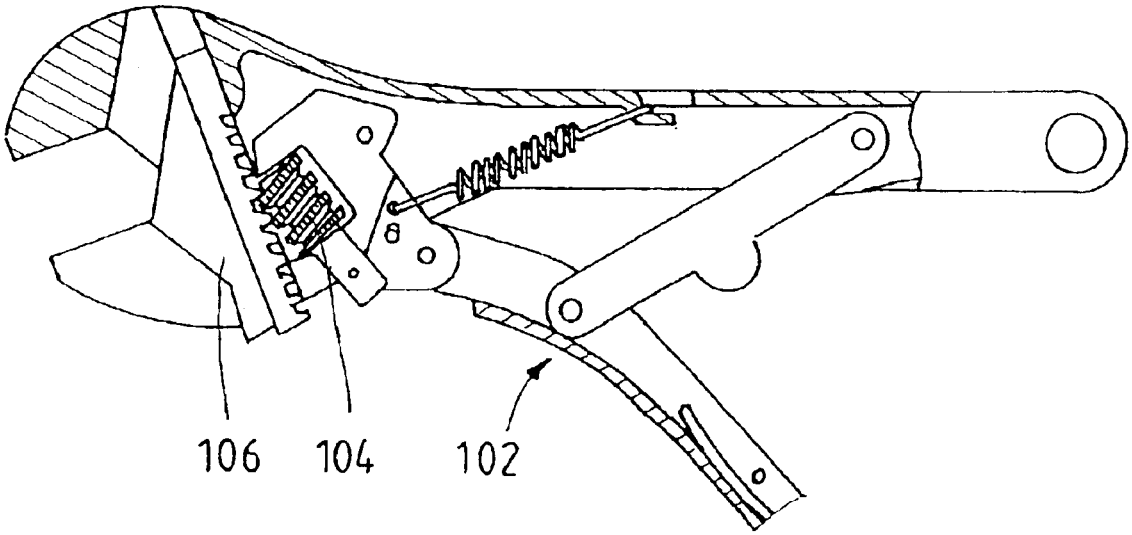
FIG.17 PRIOR ART
FIG. 17 is a perspective view of a fourth conventional adjustable wrench with apparatus to secure the movable jaw.

FIG. 10 shows a driving device 60*a* of the second type and it is a cam received in the gap 15 and pivoted on the shank 12 via a pin 62*a*. The cam 60*a* is turned to move the adjusting worm 40.

Figure 11:
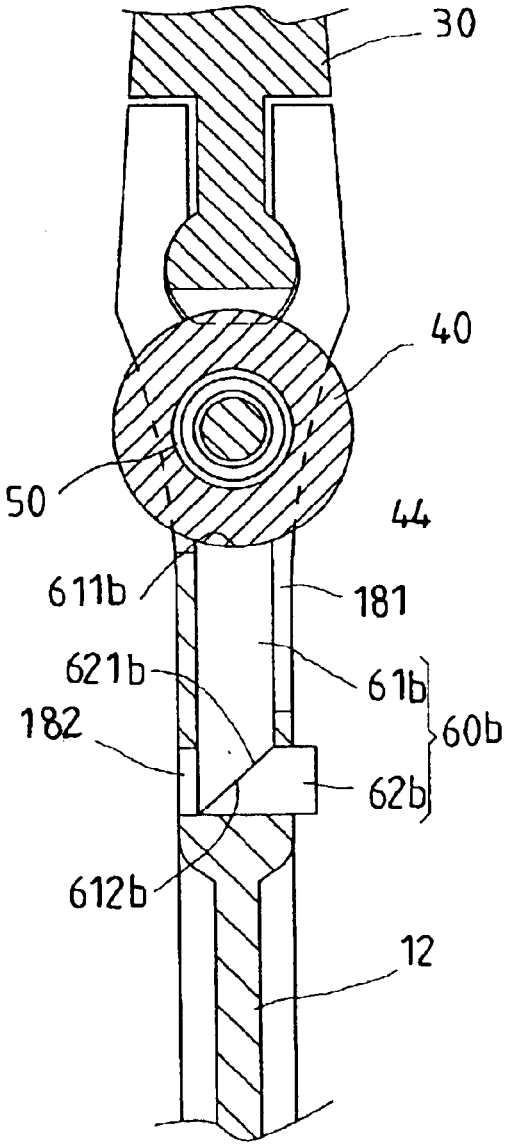
FIG. 11 is a sectional view, showing a third type of the driving device.

FIG. 11 is a driving device 60*b* of the third type having an elongated main member 61*b* and a trigger 62*b*. The main member 61*b* has a driving face 611*b* at an end thereof to be in contact with the adjusting worm 40 and an inclined face 612*b* at the other end thereof. The main member 61*b* is provided on a lengthwise track 181 of the shank 12 to slide toward and away from the adjusting worm 40. The trigger

62*b* is provided on a transverse track 182 at a rear end of the lengthwise track 181 and has an inclined face 621*b* at an end thereof in contact with the inclined face 612*b* of the main member 61*b*. The trigger 62*b* is pressed downward to driving the main member 61 moving to push the adjusting worm 40.

What is claimed is:

1. An adjustable wrench, comprising:

a handle having a head portion and shank, wherein said head portion has a fixed jaw, a transverse guiding slot and an opening communicated with said guiding slot;

a movable jaw having a guiding portion and a rack on said guiding portion, wherein said movable jaw receives said guiding portion in said guiding slot of said handle to be moved toward or away from said fixed jaw;

an adjusting worm having a through hole and a helical tooth, wherein said adjusting worm is received in said opening and engages said helical tooth with said rack of said movable jaw;

a supporting device made of a flexible material and having at least a part received in said through hole of said adjusting worm to allow said adjusting worm to be turned along said supporting device and can be moved along a diameter orientation thereof; and a driving device provided on said handle for moving said adjusting worm toward said movable jaw.

2. The adjustable wrench as defined in claim 1, wherein said supporting device comprises a shaft and a spiral member, wherein said spiral member has a larger diameter portion and two smaller diameter portions at opposite ends of said larger diameter portion respectively and said shaft has a diameter smaller than a diameter of said through hole of said adjusting worm and smaller than a diameter of said larger diameter portion of said spiral member when said shaft is inserted into said spiral member with said smaller diameter portions of said spiral member against said shaft and said shaft and said spiral member run through said through hole of said adjusting worm with said larger diameter portion of said spiral member against a sidewall of said through hole of said adjusting worm.

3. The adjustable wrench as defined in claim 1, said supporting device comprises a shaft and a spiral member, wherein said shaft has a smaller diameter portion and two large diameter portions at opposite ends of said smaller diameter portion respectively and said smaller diameter portion of said shaft has a diameter smaller than a diameter of said through hole of said adjusting worm and smaller than a diameter of said spiral member when said shaft is inserted into said spiral member with said larger diameter portions thereof against said spiral member and said shaft and said spiral member run through said through hole of said adjusting worm with said spiral member against a sidewall of said through hole of said adjusting worm.

4. The adjustable wrench as defined in claim 1, said supporting device comprises a shaft and a flexible hollow element, wherein said shaft has a diameter smaller than a diameter of said through hole of said adjusting worm and runs through said through hole and said hollow element is received in said through hole against said shaft and a sidewall of said through hole of said adjusting worm and said spiral member runs through said through hole of said adjusting worm and is mounted to a head portion of said handle.

5. The adjustable wrench as defined in claim 1, wherein said supporting device has a spiral member running through said through hole of said adjusting worm.

6. The adjustable wrench as defined in claim 5, wherein said spiral member has two smaller diameter portions at positions relative to opposite ends of said adjusting worm respectively.

7. The adjustable wrench as defined in claim 1, wherein said supporting device has a flexible shaft running through said through hole of said adjusting worm.

8. The adjustable wrench as defined in claim 7 wherein said flexible shaft has two annular recesses at positions relative to opposite ends of said adjusting worm respectively.

9. The adjustable wrench as defined in claim 1, wherein said driving device has a main member pivoted on said handle via a pin running through said handle and said main member, which has a cam face at an end thereof to be in contact with said adjusting worm while said main member is moved.

10. The adjustable wrench as defined in claim 9, wherein said driving device further has a spring against said handle and said main member respectively to position cam face of said main member not in contact with said adjusting worm at an initial position.

11. The adjustable wrench as defined in claim 1, wherein said driving device has a cam pivoted on said handle.

12. The adjustable wrench as defined in claim 1, wherein said driving device has a main member slidably provided on a guiding track of said handle, which has a driving face at an end thereof to be in contact with said adjusting worm while said main member slides.

13. The adjustable wrench as defined in claim 12, wherein said driving device further has a trigger provided on said handle for driving said main member to slide.

14. The adjustable wrench as defined in claim 13, wherein said trigger is slidably provided on said shank of said handle, which has an inclined face at an end thereof to be in contact with an inclined face of said main member.

* * * * *